US006376762B1

(12) United States Patent
French et al.

(10) Patent No.: US 6,376,762 B1
(45) Date of Patent: Apr. 23, 2002

(54) SMALL VEHICLE LAUNCH PLATFORM

(75) Inventors: Daniel W. French, Portsmouth; Paul M. Dunn, Wakefield; John J. Vaillancourt, Tiverton, all of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 53 days.

(21) Appl. No.: 09/665,277

(22) Filed: Sep. 19, 2000

(51) Int. Cl.[7] ..... F42B 19/00; F41F 3/00

(52) U.S. Cl. ..... 114/22; 114/20.1; 114/238; 114/316; 102/341; 102/399; 102/89; 102/1.804; 102/1.807; 102/1.809

(58) Field of Search ..... 114/316, 20.1, 114/21.2, 22, 238; 102/399, 390, 371, 489, 393, 374, 341; 89/1.804, 1.807, 1.809

(56) References Cited

U.S. PATENT DOCUMENTS 1,296,333 A * 3/1919 Shonnard ..... 114/20.1
3,461,801 A * 8/1969 Vitale et al. ..... 102/357
3,724,410 A * 4/1973 Lok ..... 114/259
3,969,977 A * 7/1976 Opdahl et al. ..... 114/319
4,911,058 A * 3/1990 Anderson et al. ..... 102/202.1
5,235,931 A * 8/1993 Nadolink ..... 114/257
5,660,135 A * 8/1997 Gomes et al. ..... 114/312
5,666,897 A * 9/1997 Amstrong ..... 114/20.1

* cited by examiner

*Primary Examiner*—Michael J. Carone
*Assistant Examiner*—Denise J. Buckley
(74) *Attorney, Agent, or Firm*—Michael J. McGowan; James M. Kasischke; Prithvi C. Lall

(57) ABSTRACT

A launch platform for a host vehicle. There is a cradle having a cylindrical shape with peripheral axial recesses formed therein and arranged around the cradle. A release mechanism is positioned within the cradle. The release mechanism releasably joins small cylindrical undersea vehicles positioned in said peripheral axial recesses.

11 Claims, 3 Drawing Sheets

SMALL VEHICLE LAUNCH PLATFORM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to marine vehicles and more particularly to marine vehicle launch systems.

(2) Brief Description of the Prior Art

Underwater missiles and torpedoes are currently launched from either off the side of a manned ship or from the torpedo tube of a manned submarine. The current method of deploying undersea weapons requires the actual presence of the ship and/or submarine at the deployment site, thereby posing a number of dangers, including (1) exposure of personnel and ships to enemy fire in a danger zone, and (2) detection of ships and submarines in shallow water.

Various arrangements are described in the prior art for launching a weapon or other device from an unmanned vehicle. U.S. Pat. No. 3,513,750 to Penza, for example, discloses a missile launcher including an elongate buoyant keel structure adapted to float upright in a body of water. The keel is provided with an azimuth and elevation sensing mechanism which controls a series of propulsive devices also placed on the keel and which give the launcher and an attached missile the desired launch elevation and azimuth positioning.

U.S. Pat. No. 5,076,192 to Tegel et al. discloses an unmanned submarine which is guided to the surface of the water in order to launch an air rocket contained therein and which is provided in its walls with closeable openings for the discharge of the rocket recoil gases into the surrounding water to conduct the impinging recoil gases of a launched air rocket directly out of the submarine. To create a lock for the recoil gas discharge openings which withstands high water pressures and is easily opened in the starting phase of the air rocket, the openings are disposed in the surfaces where the recoil gases impinge on the wall of the submarine, each opening is closed by a cover which is pressed out of the opening by the impinging gases, the seat for the cover in the opening is configured as an inwardly tapered conical surface, and the cover is held in the opening by a transport safety which is released by the action of the pressure of the recoil gases or the cover.

U.S. Pat. No. 5,542,333 to Hagelberg et al. discloses an undersea vehicle storage and ejection system including a capsule having a cavity therein adapted to store and launch a vehicle. The capsule has an opening at one end for passage of the vehicle therethrough. A closure member is suitably adapted to be mateable with the housing at the opening to seal the cavity. A rocket unit is incorporated within the capsule to remove the closure member at launch. The closure member includes a sealing arrangement for withstanding the hydrostatic pressure when the system is in the undersea environment of use and block the entry of seawater into the cavity. The rocket unit, when ignited, rapidly builds up pressure within the capsule to a level exceeding the external hydrostatic pressure on the cover, thereby removing the cover so that the vehicle may be launched.

U.S. Pat. No. 5,786,545 to Hillenbrand discloses a vehicle known as an unmanned undersea vehicle (UUV). The UUV includes a weapon compartment and a control means. Within the weapon compartment are a weapon and a buoyancy chamber positioned axi-symetrically therein. The buoyancy chamber is initially empty and has sufficient capacity so that it can be loaded with seawater whose mass approximates mass of the weapon. The weapon compartment further includes controllable valve means for enabling seawater surrounding the vehicle to fill the buoyancy chamber. The control means controls the deployment of the weapon by expelling the weapon from the weapon compartment and thereafter controls the firing of the weapon. The control means further controls the valves during weapon deployment to enable filling of the buoyancy chamber to maintain a predetermined distribution of mass as the weapon is deployed, which filling-of-the-chamber acts with bilateral symmetry on opposing sides of a vertical reference plane through the vehicle's axis. The mother vehicle generates command information for controlling the control means and receives unmanned undersea vehicle status information from the unmanned undersea vehicle and processes it for use in generating the command information. The communication link interconnects the unmanned undersea vehicle and the mother vehicle to facilitate transfer of command information from the mother vehicle to the unmanned undersea vehicle and to facilitate transfer of unmanned undersea vehicle status information from the unmanned undersea vehicle to the mother vehicle.

SUMMARY OF THE INVENTION

It is an object of the invention to allow a smaller UUV to be launched or jettisoned from a larger or host UUV.

It is a further object to mount the smaller UUV's within the same diameter as the host UUV.

Yet another object is allowing the host UUV to launch the smaller UUV's without adversely affecting its buoyancy.

Accordingly, the undersea launch platform of the present invention includes a host vehicle, which is preferably, a larger UUV having a generally cylindrical hull. A cradle projection extends from the hull of the host vehicle. A carried vessel, which is preferably a small UUV, is mounted on the forward axial cradle projection.

This launch platform would allow the larger UUV, preferably with a tactical diameter of 21 inches, to significantly expand its area of operation by carrying one or more small UUV's. The small UUV's could be launched individually at any time during the larger UUV's mission. The smaller UUV's, when equipped with sensors, i.e., sonar, oceanographic instrumentation, etc., could obtain data in their own region of operation and relay that information, via submerged acoustic communications submerged or surface radio communications, back to the larger UUV or another vehicle. This deployment and operation technique would substantially expand the area of coverage of the larger UUV.

BRIEF DESCRIPTION OF THE DRAWINGS

Other objects, features and advantages of the present invention will become apparent upon reference to the following description of the preferred embodiments and to the drawing, wherein corresponding reference characters indicate corresponding parts in the drawing and wherein.

DESCRIPTION OF THE PREFERRED EMBODIMENT

Figure 1:
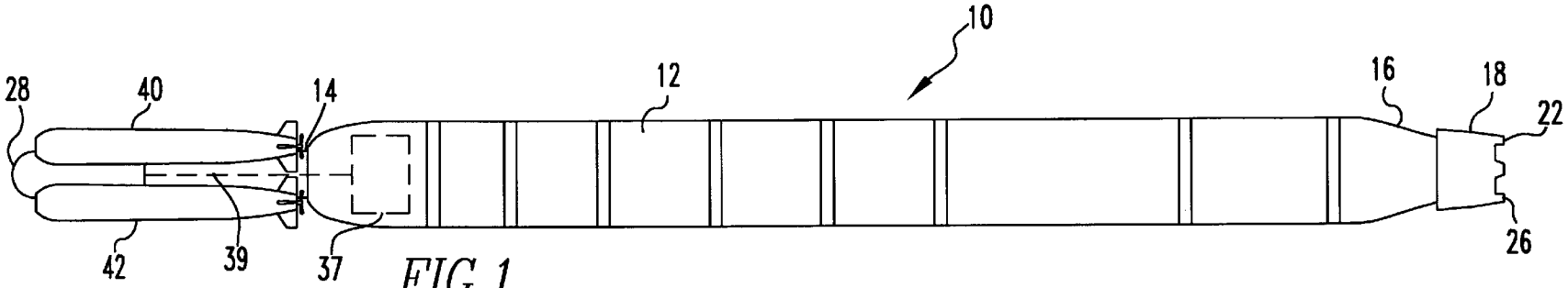
FIG. 1 is a side elevational view of a preferred embodiment of the launch platform assembly of the present invention.

Referring to the drawings, the assembly of the present invention includes a host vehicle 10, which can be a UUV as is described in the aforesaid U.S. Pat. No. 5,786,545 to Hillenbrand, the contents of which are incorporated herein by reference. The control and propulsion features of the UUV are described by Hillenbrand, but, briefly the UUV 10 contains a cylindrical hull 12 with a convex bow 14 and a converging stern section 16 on which there is mounted a stern propeller assembly 18. Also adjacent the converging stern section 16 there are stern stabilizing fins 20, 22, 24 and 26. Extending forward from the convex bow 14 there is a forward axial cradle 28, which includes peripheral axial recesses 30, 32, 34 and 36. It will be noted that in this embodiment these axial recesses are peripherally positioned at about 90° from adjacent recesses. In each of these axial recesses there is, respectively, mounted a small UUV 38, 40, 42 and 44. Each of the UUV's as, for example, small UUV 38 includes a cylindrical hull 46, a convex bow 48, a converging stern section 50 and a stern propeller assembly 52. UUV 38 also includes stern stabilizing fins 54, 56, 58 and 60. The control and propulsion features of UUV 38 are conventional as is, for example, disclosed in the aforesaid Hillenbrand patent. It will be also understood that the other small UUV's 40, 42 and 44 typically identical to UUV 38.

A controller 37 is positioned within hull 12. Controller 37 is joined by a control line 39 to release mechanisms 41 joined between cradle 28 and small UUV's 38, 40, 42 and 44.

Those skilled in the art will appreciate that release mechanisms-41 can be a spring-loaded release pin with a lanyard pull initiated by an actuator mechanism or an explosive squib which breaks the attachment latching on the small UUV. Whatever release mechanism is used, it is controlled by the host UUV's control computer 37. Each release mechanism 41 joining a small UUV is independent, allowing the small UUV's to be deployed separately.

Figure 2:
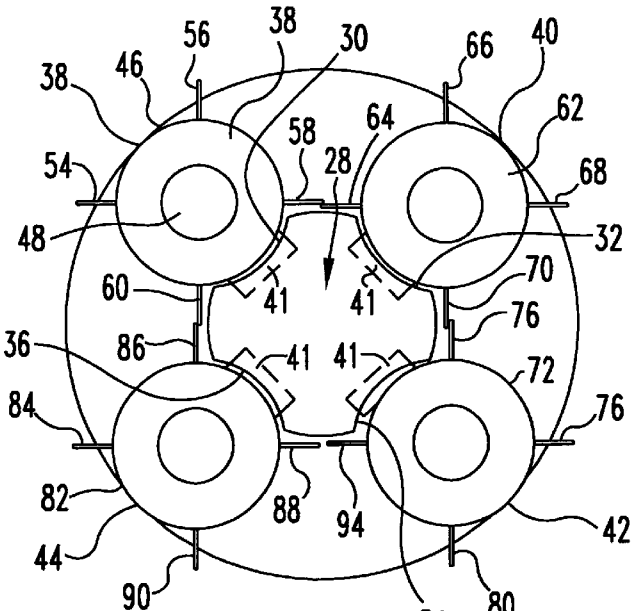
FIG. 2 is a front end view of the assembly shown in FIG. 1.
Figure 3:
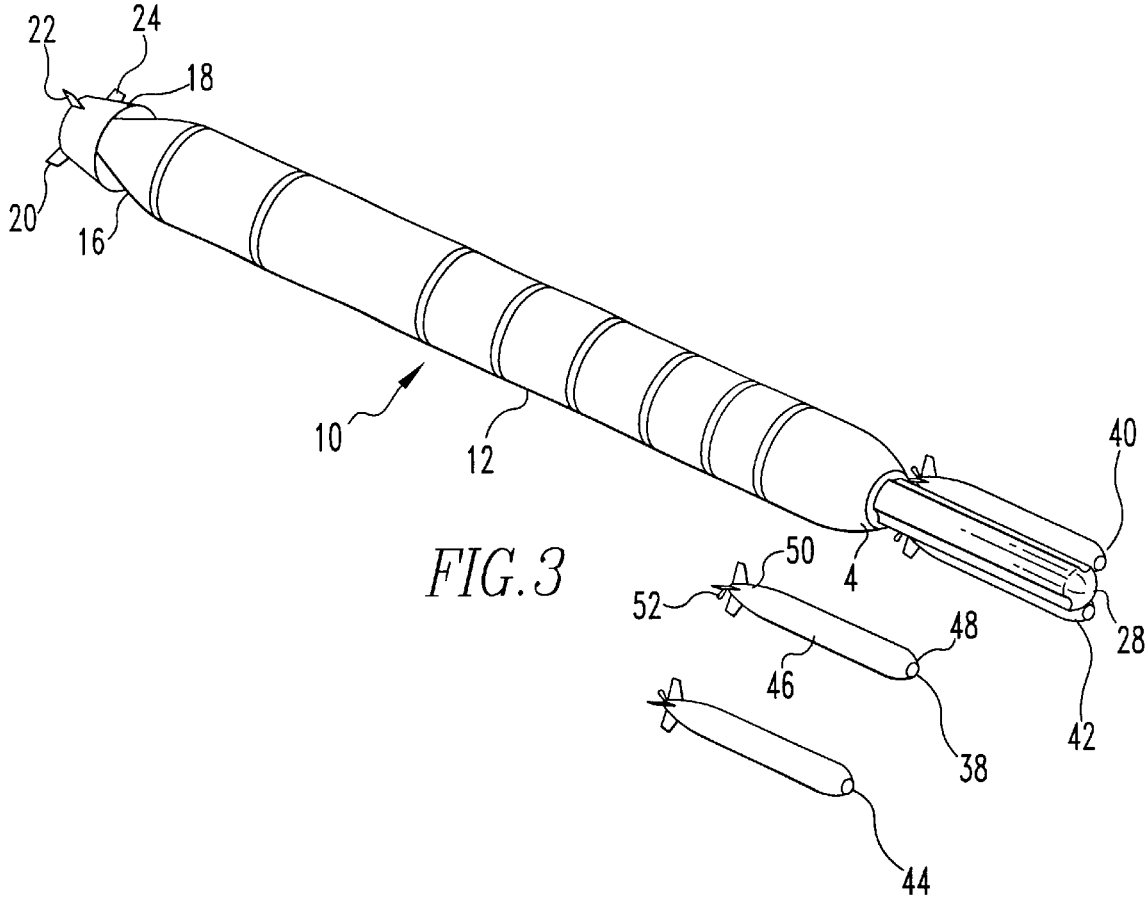
FIG. 3 is a perspective view of the assembly shown in FIG. 1 immediately after release of two small UUV's.
Figure 4:
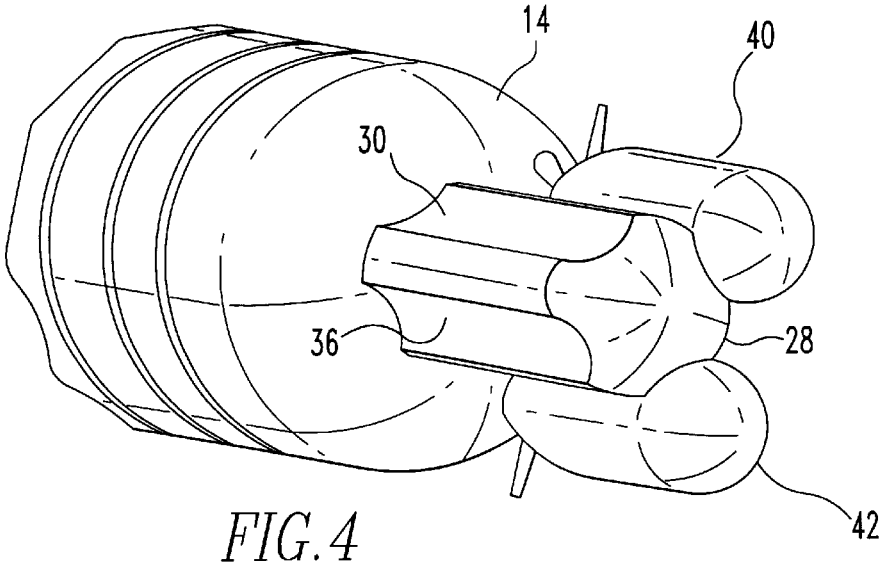
FIG. 4 is a detailed view of area 4 in FIG. 3.
Figure 5:
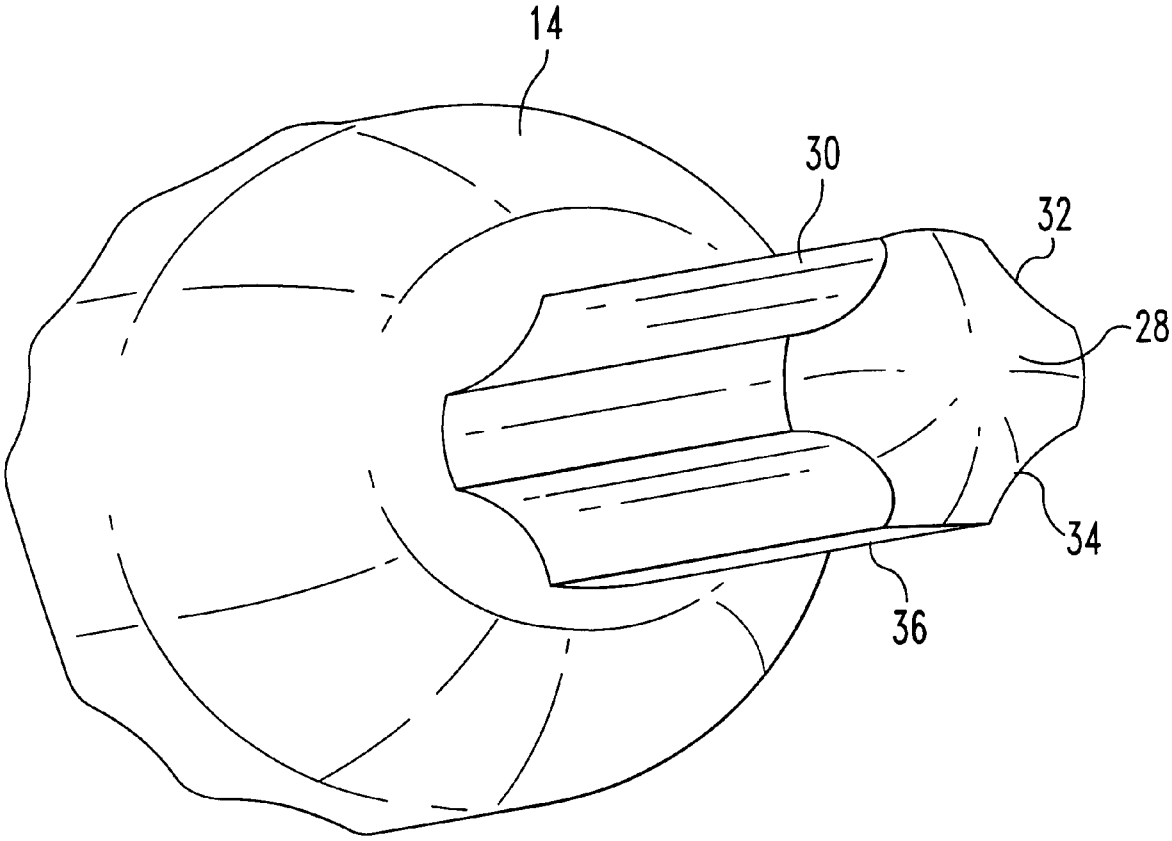
FIG. 5 is a view similar to FIG. 4 after release of all the small UUV's.

Referring particularly to FIG. 2, it will be seen that small UUV 40 has a cylindrical hull 62 and stern stabilizing fins 64, 66, 68 and 70. Fins 58 on small UUV 38 and fins 64 on small UUV 40 slightly overlap so fins on its upper side continuously overlap the periphery of the forward axial cradle 28. Small UUV 42 has a cylindrical hull 72 and stern stabilizing fins 74, 76, 78 and 80. It will also be noted that fin 70 on small UUV 40 and fin 76 on small UUV 42 overlap so as to continuously overlap the axial cradle 28 on one of its axial sides. Small UUV 44 also has a cylindrical hull 82 and stern fins 84, 86, 88 and 90. It will be observed that fin 74 on small UUV 42 and fins 88 on small UUV 44 overlap to continuously overlap the forward axial cradle 28 on its lower side, and fin 60 on small UUV 38 and fin 86 on small UUV 44 overlap to continuously overlap the forward axial cradle 28 on its other lateral side. It will also be observed that the stern fins 54 and 56 on small UUV 38, fins 66 and 68 on small UUV 40, fins 76 and 80 on small UUV 42, and fins 84 and 90 on small UUV 40 extend slightly beyond the periphery of the cylindrical hull 12 of the host vehicle 10. The cylindrical hulls at cylindrical hull 86 of the small UUV's 38, 40, 42 and 44 are, however, confined within the diameter of the cylindrical hull 12 of the host vehicle 10 so as to allow torpedo tube and swimout cage capability.

It will be appreciated that the launch of the small UUV can be executed with several different techniques. The small UUV can start its own propeller and swim away from the host at a greater velocity than the host. The small UUV can also be jettisoned from the host, either outboard or forward of the host UUV. Jettison methods include actuators or springs, which push the small UUV in the desired direction. After jettison, the small UUV can power away on its own.

Another launch technique require deceleration of the host UUV and simultaneously release of the small UUV allowing the small UUV's inertia to carry it forward of the host UUV. The small UUV then powers away.

Preferably, the small UUV's is packaged together on the cradle in such a way as to not exceed the standard 21 inch diameter of the host. This allows typical tube launch or cage swimout. If the fins on the small UUV are required to be larger for control purposes and extend beyond the standard 21 inch diameter, they should be pop out fins which extend during the small UUV's launch sequence.

Although the embodiment described above carries four small UUV's, it will be understood that, depending on the size of the small UUV's employed, greater or fewer numbers of UUV's can be carried. It will also be understood that the cradle projection does not need to be mounted on the bow, and in alternate embodiments the cradle projection can be mounted anywhere on the cylindrical hull. This option should incorporate the off-board jettison launch technique described above.

The invention allows multiple UUV's to be launched individually or together at any time. This operational technique allows the host UUV to significantly expand its operational area. These multiple UUV's can be networked together via acoustic or other communications to effectively generate a UUV with tremendous range and coverage for whatever mission is desired.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A launch platform for a host vehicle;

a cradle having a generally cylindrical shape with peripheral axial recesses formed therein and arrayed around the cradle; and a release mechanism positioned within said cradle and adapted to releasably join small cylindrical undersea vehicles positioned in said peripheral axial recesses.

2. The system of claim 1 wherein said cradle is positioned axially extending from the bow of said host vehicle.

3. The system of claim 1 wherein said host vehicle is cylindrical in shape and said cradle is formed for positioning said small cylindrical undersea vehicles with the radius of said host vehicle.

4. The system of claim 1 wherein said release mechanism is at least one actuated spring loaded release pin positioned in said cradle and adapted to join said small cylindrical undersea vehicles.

5. The system of claim 1 wherein said release mechanism is at least one explosive squib positioned in said cradle and adapted to join said small cylindrical undersea vehicles.

6. An undersea launch platform assembly comprising:

a host vehicle having a bow, a stern and a generally cylindrical hull;

a cradle projection extending from the host vehicle bow, and said cradle projection having at least one peripheral axial recess; and at least one carried vehicle mounted on the cradle projection with one carried vehicle being mounted in each said peripheral axial recess.

7. The system of claim 6 wherein the carried vehicle has a generally cylindrical hull.

8. The system of claim 7 wherein the carried vehicle has a stern and a plurality of stabilizing fins mounted adjacent said stern.

9. The system as in claim 6 further comprising a release mechanism positioned within said cradle projection releasably joining each carried vehicle within said peripheral axial recess, said host vehicle having a controller joined to said release mechanism for actuating said release.

10. The system as in claim 9 wherein said release mechanism is an actuated spring loaded release pin positioned in said cradle projection and releasably joining said carried vehicle.

11. The system as in claim 9 wherein said release mechanism is an explosive squib positioned in said cradle projection and releasably joining said carried vehicle.

* * * * *